US009023128B2

(12) United States Patent
Li et al.

(10) Patent No.: US 9,023,128 B2
(45) Date of Patent: May 5, 2015

(54) METHODS OF PRODUCING NANOPARTICLE REINFORCED METAL MATRIX NANOCOMPOSITES FROM MASTER NANOCOMPOSITES

(75) Inventors: Xiaochun Li, Madison, WI (US); Michael Peter De Cicco, Madison, WI (US); Dake Wang, Sheboygan, WI (US); Hongseok Choi, Madison, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 126 days.

(21) Appl. No.: 13/331,243

(22) Filed: Dec. 20, 2011

(65) Prior Publication Data

US 2013/0152739 A1 Jun. 20, 2013

(51) Int. Cl.

| | |
|---|---|
| ***C21C 7/00*** | (2006.01) |
| ***C22C 1/10*** | (2006.01) |
| ***C22C 21/00*** | (2006.01) |
| ***C22C 21/06*** | (2006.01) |
| *C22B 21/00* | (2006.01) |
| *C22C 32/00* | (2006.01) |

(52) U.S. Cl.

CPC ..... *C22C 1/1036* (2013.01); *C22C 21/00* (2013.01); *C22C 21/06* (2013.01); *C22C 32/00* (2013.01)

(58) Field of Classification Search

USPC ..... 75/414, 560, 684

See application file for complete search history.

(56) References Cited

U.S. PATENT DOCUMENTS 7,509,993 B1 * 3/2009 Turng et al. ..... 164/97
2006/0019115 A1 * 1/2006 Wang et al. ..... 428/570

FOREIGN PATENT DOCUMENTS

DE 10 2007 044 565 4/2009
DE 102007044565 A1 * 4/2009 ..... C22C 1/10

OTHER PUBLICATIONS

Chawla et al., Mechanical Behavior of Particle Reinforced Metal Matrix Composites, Advanced Engineering Materials, May 31, 2001, vol. 3, No. 6, pp. 357-370.

DeCicco et al., Paper presented at TMS 2011, 140th Annual Meeting & Exhibition, Mar. 3, 2011.

DeCicco et al., Abstract submitted to TMS 2011, 140th Annual Meeting & Exhibition, published online Feb. 2, 2011.

Quested, Understanding mechanisms of grain refinement of aluminium alloys by inoculation, Materials Science and Technology, Nov. 2004, vol. 20, pp. 1357-1369.

Ramachandran et al., Grain Refinement of Light Alloys, Proceedings of 68th World Foundry Congress, Feb. 7-10, 2008, Chennai, India, pp. 189-193.

Shepelev et al., Grain refinement and mechanical properties enhancement of AZ91E alloy by addition of ceramic particles, J Mater Sci, Apr. 20, 2011, vol. 46, pp. 5798-5806.

* cited by examiner

*Primary Examiner* — Kaj K Olsen
*Assistant Examiner* — Alexander Polyansky
(74) *Attorney, Agent, or Firm* — Bell & Manning, LLC

(57) ABSTRACT

Methods of forming metal matrix nanocomposites are provided. The methods include the steps of introducing a master metal matrix nanocomposite into a molten metal at a temperature above the melting temperature of the master metal matrix nanocomposite, allowing at least a portion of the master metal matrix nanocomposite to mix with the molten metal and, then, solidifying the molten metal to provide a second metal matrix nanocomposite.

17 Claims, 2 Drawing Sheets

METHODS OF PRODUCING NANOPARTICLE REINFORCED METAL MATRIX NANOCOMPOSITES FROM MASTER NANOCOMPOSITES

REFERENCE TO GOVERNMENT RIGHTS

This invention was made with government support under 70NANB10H003 awarded by the National Institute of Standards and Technology (NIST). The government has certain rights in the invention.

BACKGROUND

A nanocomposite includes a matrix material and nanoparticles which have been added to the matrix material to improve a particular property of the material. For example, nanoparticles can be added to materials to make them lightweight, while simultaneously increasing the strength of the materials. Nanocomposites having high strength-to-weight ratios are of interest to industries, such as the aerospace and automotive industries, provided they can be produced at a reasonable cost with properties comparable to more conventional, heavier materials.

Metal matrix nanocomposites (MMNCs) are a type of nanocomposite in which nanoparticles, such as ceramic nanoparticles, are added to a metal matrix. MMNCs are desirable because they can be made from relatively inexpensive, abundant metals with strengths comparable to those of more expensive alloys. However, for some material systems it is very difficult to process nanoparticles into metal alloys. For such systems, expertise and specialized training in nanoparticle processing and handling are typically required to fabricate the nanocomposite. As a result large-scale MMNC production at foundries can be hampered in the absence of highly qualified personnel or a simplified method for MMNC production.

SUMMARY

Methods of forming metal matrix nanocomposites are provided. In some embodiments the methods comprise the steps of: (1) introducing a master metal matrix nanocomposite into a molten metal at a temperature above the melting temperature of the master metal matrix nanocomposite, the master metal matrix nanocomposite comprising a first matrix metal and a plurality of nanoparticles dispersed in the first matrix metal; (2) allowing at least a portion of the master metal matrix nanocomposite to melt in the molten metal; and (3) solidifying the molten metal to provide a second metal matrix nanocomposite comprising a second matrix metal and at least a portion of the plurality of the nanoparticles dispersed in the second matrix metal. In some embodiments, the compositions of the molten metal and the matrix metal of the master metal matrix nanocomposite differ, such that the nanoparticles have a higher wettability in the matrix metal of the master metal matrix nanocomposite than in the molten metal. In some such embodiments, the molten metal is aluminum or an aluminum alloy. The first matrix metal may be an alloy comprising a primary metal element and a wettability enhancing metal element. In some embodiments the wettability enhancing element is not present in the molten metal prior to the introduction of the master nanocomposite.

In some embodiments the methods comprise the steps of: (1) introducing a master metal matrix nanocomposite into a molten metal at a temperature above the melting temperature of the master metal matrix nanocomposite, the master metal matrix nanocomposite comprising a first matrix metal and a plurality of nanoparticles dispersed in the first matrix metal, wherein the first matrix metal and the molten metal do not have a primary metal element in common; (2) allowing at least a portion of the master metal matrix nanocomposite to melt in the molten metal; and (3) solidifying the molten metal to provide a second metal matrix nanocomposite comprising a second matrix metal and at least a portion of the plurality of the nanoparticles dispersed in the second matrix metal.

In some embodiments the methods comprise the steps of: (1) introducing a master metal matrix nanocomposite into a molten metal at a temperature above the melting temperature of the master metal matrix nanocomposite, the master metal matrix nanocomposite comprising a first matrix metal and a plurality of nanoparticles dispersed in the first matrix metal, wherein the first matrix metal has a lower melting point than the molten metal; allowing at least a portion of the master metal matrix nanocomposite to melt in the molten metal; and solidifying the molten metal to provide a second metal matrix nanocomposite comprising a second matrix metal and a plurality of the nanoparticles dispersed in the second matrix metal.

Other principal features and advantages of the invention will become apparent to those skilled in the art upon review of the following drawings, the detailed description, and the appended claims.

BRIEF DESCRIPTION OF THE DRAWINGS

Illustrative embodiments of the invention will hereafter be described with reference to the accompanying drawings.

DETAILED DESCRIPTION

Figure 1:
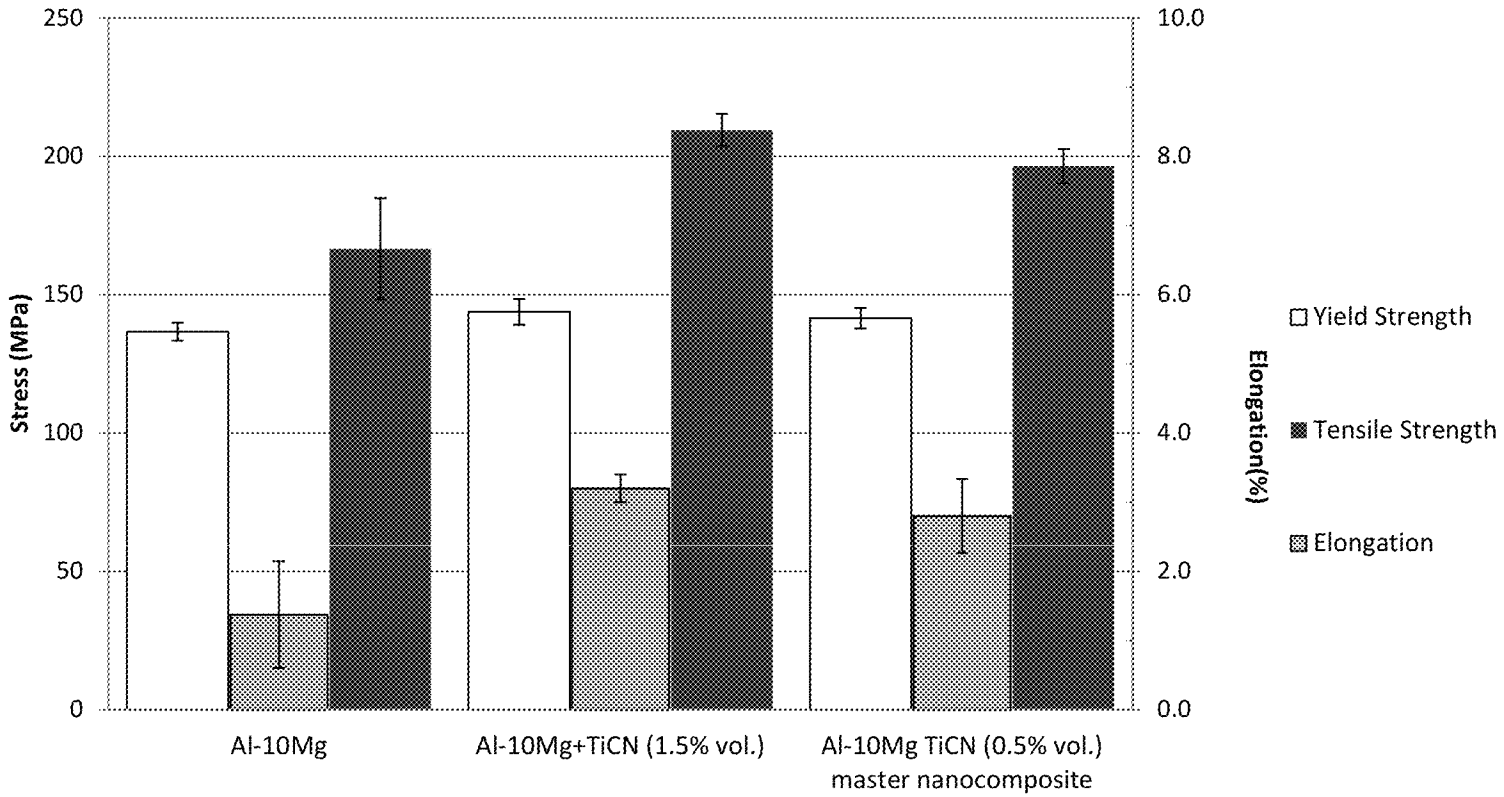
FIG. 1 shows tensile testing results comparing monolithic Al-10Mg, Al-10Mg+1.5% $TiC_{0.7}N_{0.3}$ nanocomposite and Al-10Mg+0.5% $TiC_{0.7}N_{0.3}$ nanocomposite. (The percent provided in the formula represents volume percent.)

Methods of forming metal matrix nanocomposites are provided. The methods include the steps of introducing a master metal matrix nanocomposite (also referred to as a "master nanocomposite") comprising a first metal matrix nanocomposite into a molten metal at a temperature above the melting temperature of the master metal matrix nanocomposite, allowing at least a portion of the master nanocomposite to form a mixture with the molten metal and, then, solidifying the molten metal to provide a second metal matrix nanocomposite.

The master metal matrix nanocomposite comprises a first matrix metal and a plurality of nanoparticles dispersed in the first matrix metal. The master metal matrix nanocomposite can be introduced into the molten metal in a solid form in which the first matrix metal is a solid with the plurality of nanoparticles dispersed therein. Alternatively, the master metal matrix nanocomposite can be introduced into the molten metal in a liquid form in which the first matrix metal is in the liquid phase with the plurality of nanoparticles dispersed therein. The second metal matrix nanocomposite comprises a second matrix metal with a plurality of the nanoparticles from the master nanocomposite dispersed therein. In some embodiments, the particles in the master nanocomposite are homogeneously dispersed as individual nanoparticles which remain homogeneously dispersed as individual nanoparticles in the second metal matrix nanocomposite. In other embodiments, the nanoparticles of the first and/or second metal matrix nanocomposites are distributed along grain boundaries in the nanocomposites.

In the present methods of forming metal matrix nanocomposites the master metal matrix nanocomposite can be introduced into the molten metal (the 'melt') by completely or partially immersing it in the melt. The master nanocomposite is left in contact with the molten metal, with our without stirring, for a time sufficient to completely or partially melt the master nanocomposite into the molten metal. After at least a portion of the master nanocomposite has melted into the molten metal, the molten metal can be cast to form a second metal matrix nanocomposite. Alternatively, if the master nanocomposite is in the liquid form, it can be introduced into the melt simply by adding it into the melt. If the master nanocomposite is initially received as (or formed as) a solid, it can be pre-melted into a liquid form prior to addition to the melt. Thus, the methods provide the second metal matrix nanocomposite with a lower concentration of the nanoparticles than the master metal matrix nanocomposite.

One advantage of the use of a master nanocomposite is that it allows the initial volume of metal processed with the nanoparticles to be reduced relative to a process in which the nanoparticles are added at their intended, final concentration to a melt which will be cast into the final nanocomposite. This approach is beneficial because it enables the sale of solid master nanocomposites to foundries where they can be used easily to cast nanocomposites with a desired nanoparticle loading without the need for training or expertise in nanoparticle handling and processing.

In addition, it has been discovered that in embodiments where the nanoparticles in the master nanocomposite are fully wetted by, and dispersed in, the matrix metal they can remain dispersed as individual nanoparticles and/or small nanoparticle agglomerates in the melt into which the master nanocomposite is introduced, without significant (e.g., without detectable) settling or agglomeration. This may be true even in the absence of stirring or agitation, as in the case where the convective flow in the melt is sufficient to distribute the nanoparticles released from the master nanocomposite throughout the melt.

Yet another advantage of the present methods is that they make it possible to independently select the matrix metal of the master nanocomposite and the metal of the melt into which the master nanocomposite will be introduced in order to optimize nanoparticle processing during the production of the master nanocomposite. For example, in the production of a final metal matrix nanocomposite comprising an alloy matrix metal, the metal element or elements of the alloy that most readily wet the nanoparticles can be selected as the matrix metal for the master nanocomposite while the remaining metal element or elements can be melted into the molten metal into which master nanocomposite is introduced. Thus, in some embodiments, one or more metal elements present in the matrix metal of the master nanocomposite will be absent from the melt and/or vice versa.

The matrix metal of the master nanocomposite can be a pure metal or a metal alloy. Examples of metals that can be used as a matrix metal include aluminum, magnesium, nickel, copper, zinc, tin, lead, iron, titanium and alloys of these metals with each other or other metals.

In some embodiments, the matrix metal of the master nanocomposite is an alloy in which one of the elements is a metal that serves as a wettability enhancing element to enhance the wettability of the nanoparticles by the matrix metal relative to the wettability of the nanoparticles in the absence of the wettability enhancing element. (Because the ability of an element to enhance wettability may depend on the concentration of that element in a composition, said element is only considered to be a wettability enhancing element if it is present in sufficient quantities to enhance the wettability of the metal matrix on the nanoparticles.) For example, if the primary metal element of the matrix metal (i.e., the metal element that is present in the greatest percent by weight in the matrix metal) is aluminum and the nanoparticles are oxide nanoparticles, such as $Al_2O_3$, titanium can be included in the metal matrix to enhance the wetting of the metal on the nanoparticles during the formation of the master nanocomposite. In such embodiments, the wettability enhancing element will typically be a minor element in the matrix metal. For the purposes of this disclosure, a minor element is one that is present at a concentration of less than 50 percent by weight (wt. %), while a major element is one that is present at a concentration of at least 50 percent by weight. In some embodiments the wettability enhancing element is present in the matrix metal of the master nanocomposite at a concentration of no greater than about 20 wt. %. This includes embodiments in which the wettability enhancing element is present at a concentration of no greater than about 10 wt. % and further includes embodiments in which the wettability enhancing element is present at a concentration of no greater than about 1 wt. %. It is possible for the wettability enhancing element to be an element that facilitates nanoparticle processing in the master nanocomposite (e.g., by enhancing wetting) but degrades, or at least does not enhance, the mechanical properties of the final metal matrix nanocomposite. In such cases, the wettability enhancing element can be incorporated into the master nanocomposite at a low concentration, such that it is diluted to a trace (e.g., less than about 0.5 wt. %) in the final metal matrix nanocomposite.

In some embodiments of the present methods, the primary purpose of the nanoparticles in the master nanocomposite is to enhance the mechanical properties of the final metal matrix nanocomposite cast from the melt. For example, the nanoparticles can serve to provide higher strength, higher stiffness and/or lower weight relative to the properties of the metal in the absence of the nanoparticles. In some such embodiments, the nanoparticles act as grain refiners in the nanocomposite. For example, the nanoparticles in the nanocomposites may act as nucleation sites for grains in the nanocomposite. However, in other embodiments some or all of the nanoparticles in the master nanocomposite do not act as grain refiners, as in the case where they merely provide reinforcement through the transfer of an applied load from the metal matrix to the (usually stiffer) nanoparticles. Other nanoparticle-induced strengthening mechanisms include dislocation densification, dislocation pinning and hindering grain boundary slip. Thus, the present methods can be used to improve the mechanical properties of metal alloys that do not benefit from particle-induced grain refinement.

Materials from which the nanoparticles can be made include, but are not limited to, ceramics, oxides, nitrides, borides, carbides and other carbon-based particles, metals and metal alloys. Specific examples of the types of nanoparticles that may be dispersed in the metal matrices include aluminum oxide nanoparticles, aluminum nitride nanoparticles, carbon nanotubes, silicon carbide nanoparticles, silicon nitride nanoparticles, titanium carbide nanoparticles, titanium carbonitride nanoparticles and tungsten carbide nanoparticles. In addition, the nanoparticles can be core-shell type nanoparticles that include a core material and a coating.

Examples include SiC nanoparticles coated with $SiO_2$ and ceramic nanoparticles coated with a metal such as nickel or silver.

For the purposes of this disclosure, the term "nanoparticle" is used to refer to a particle having at least one dimension that is no greater than about 500 nm. This includes particles having at least one dimension that is no greater than about 200 nm, further includes particles having at least one dimension that is no greater than about 100 nm and still further includes particles having at least one dimension that is no greater than about 50 nm. In some embodiments these dimensions represent the average nanoparticle dimensions for all of the nanoparticles in the composites. The nanoparticles in the master nanocomposite and the final nanocomposite can have a narrow size distribution. For example, the size distribution of the nanoparticles can have a full width half maximum of 500 nm or less. Nanoparticles with broader size distributions can also be used. In some embodiments, all of the particles in the master nanocomposite are nanoparticles, while in other embodiments the particles can include a mixture of nanoparticles and larger particles.

Some nanoparticles may have only a single dimension that is no greater than about 500 nm. These include thin flakes. Other nanoparticles may have two dimensions (e.g., height and width) that are no greater than about 500 nm. These include nanotubes and nanowires. Still other nanoparticles may have no dimension that exceeds 500 nm. In some embodiments, it is desirable that the longest dimension of the nanoparticle is no greater than about 500 μm. This includes embodiments in which the longest dimension of the nanoparticle is no greater than about 10 μm and further includes embodiments in which the longest dimension of the nanoparticle is no greater than about 1 μm. As evidenced by the description above, the term "nanoparticle" is not intended to refer to particles of a particular shape. Thus, the nanoparticles can take on a variety of forms including, but not limited, spherical or substantially spherical, elongated, cylindrical, or planar. In some cases the shapes will be irregular.

The concentration of nanoparticles in the master nanocomposite will depend, at least in part, on the desired nanoparticle concentration of the final metal matrix nanocomposite. In a typical embodiment, the concentration of nanoparticles in the master nanocomposite will be at least twice that of the desired nanoparticle concentration of the final metal matrix nanocomposite. By way of illustration only, the master nanocomposites may have a nanoparticle concentration of at least 1 volume percent (vol. %). This includes embodiments in which the master nanocomposites have a nanoparticle concentration of at least 10 vol. % and further includes embodiments in which the master nanocomposites have a nanoparticle concentration of at least 20 vol. %.

The nanoparticles are desirably sufficiently wetted by the matrix metal of the master nanocomposite to provide a metal matrix nanocomposite in which the nanoparticles are dispersed as individual nanoparticles and/or small agglomerates in the matrix metal, rather than being dispersed as large nanoparticle agglomerates. In particular, it is desirable if the size of the nanoparticle agglomerate in the metal matrix nanocomposite is sufficiently small that the agglomerates do not measurably degrade the mechanical properties of the nanocomposite relative to the unreinforced metal. In some embodiments the nanoparticle agglomerates are sufficiently small that they are able to stay mixed in the matrix metal despite buoyancy forces or under conditions where convective drag dominates over buoyancy forces in the metal matrix.

The master nanocomposites can be produced by mixing the nanoparticles, which will generally be made ex situ, into a melt of the master nanocomposite matrix metal at the desired concentration. The mixing process can involve, for example, mechanical mixing and/or cavitation. Alternatively, the nanoparticles can be made in situ by reactions between precursor species and the melt. The size of the master nanocomposite can vary over a broad range, depending on the anticipated number of times it will be used to form a final metal matrix nanocomposite. Thus, in some embodiments, the master nanocomposite can be made using laboratory scale mixing techniques. However, in other embodiments, it will be advantageous to use an industrial-scale master nanocomposite.

Like the metal that makes up the matrix of the master nanocomposite, the molten metal that makes up the melt into which the master nanocomposite is introduced can be a pure metal or a metal alloy. Examples of metals that can be used in the melt include, but are not limited to, aluminum, magnesium, nickel, copper, titanium, vanadium, tin, lead, zinc, iron, chromium and their alloys. Stainless steel is an example of an iron alloy that is suitable for use as the molten metal.

The matrix metal of the final metal matrix nanocomposite will be a combination of the master nanocomposite matrix metal and the melt metal. The ratio of the melt metal to the master nanocomposite matrix metal in the final nanocomposite can vary over a broad range. For example, in some embodiments, the master nanocomposite matrix metal may be heavily diluted to a trace amount in the final nanocomposite. For example, the matrix metal of the final metal matrix nanocomposite may comprise less than 1 wt. %, less than 0.5 wt. % or less than 0.1 wt. % master nanocomposite matrix metal. In other embodiments, the master nanocomposite matrix metal can be present in substantial quantities in the final nanocomposite. For example, in some embodiments, the matrix metal of the final metal matrix nanocomposite may comprise at least 1 wt. %, at least 5 wt. %, at least 10 wt. %, at least 20 wt. %, or at least 30 wt. % master nanocomposite matrix metal.

The metal of the melt may differ from that of the master nanocomposite matrix metal in its chemical make-up, chemical properties and/or physical properties. Examples of embodiments in which the melt and the matrix metal of the master nanocomposite have a different chemical make-up include embodiments wherein one or more elements present in the melt are absent from the matrix metal and vice versa; embodiments in which the same elements are present in the melt and in the matrix metal at different weight ratios; embodiments in which the melt and the matrix metal have no major elements in common; embodiments in which the melt and the matrix metal have different primary elements; and embodiments in which the melt and the matrix metal have no elements in common.

Examples of embodiments in which the melt and the matrix metal of the master nanocomposite have different properties include embodiments in which the melt and the matrix metal exhibit different wettabilites on the nanoparticles; embodiments in which the melt and the matrix metal have different melting points; embodiments in which the melt and the matrix metals have different chemical reactivities toward the processing equipment used to make the nanocomposites; and embodiments in which the melt and the matrix metals have different chemical reactivities toward the nanoparticles. (For the purposes of this disclosure the wettability of a metal on a nanoparticle can be determined based on contact angle measurements for the liquid metal on the material from which the nanoparticle is made using ASTM D7334-08—Standard Practice for Surface Wettability of Coatings, Substrates and Pigments by Advancing Contact Angle Measurement.) For example, the metal of the melt may have a higher melting point than the master nanocomposite matrix metal; may be less effective at wetting the surfaces of the nanoparticles than the master nanocomposite matrix metal; and/or may be less chemically reactive toward the nanoparticles than the master nanocomposite matrix metal. These and other relative properties of the master nanocomposite matrix metal and the melt metal can be selected in order to make processing the nanoparticles into a metal matrix more efficient, while allowing for the fabrication of a desired matrix alloy in the final metal matrix nanocomposite. For example, the present methods can be used to form a nanoparticle reinforced titanium alloy (i.e., a metal alloy in which titanium in the primary element), such as Ti-6Al—V, using aluminum as the matrix metal in a master nanocomposite with a high nanoparticle fraction and using titanium and vanadium in the melt. This is advantageous because titanium is very reactive in its molten state and has a high melting temperature, which makes titanium a difficult metal in which to process nanoparticles at a high loading. In another exemplary embodiment, the present methods can be used to form a nanoparticle reinforced aluminum alloy (i.e., a metal alloy in which aluminum is the primary element) in which zinc is the primary alloying element (e.g., a 7000 series Al alloy). This can be accomplished by using zinc as a master nanocomposite matrix metal and aluminum as a melt metal, allowing the initial nanoparticle processing to take place in zinc, which has a lower melting point, is less reactive toward iron, and wets some ceramics more readily than aluminum.

The concentration of nanoparticles in the final metal matrix nanocomposites will depend, at least in part, on the desired properties (e.g., strength, wear-resistance, temperature stability, ductility and thermal and electrical conductivity) of the nanocomposites. By way of illustration only, the present methods can be used to fabricate final nanocomposites having a nanoparticle concentration in the range from about 0.1 to 10 volume percent (vol. %). This includes embodiments in which the nanocomposites have a nanoparticle concentration in the range from about 0.1 to 5 vol. % and further includes embodiments in which the nanocomposites have a nanoparticle concentration in the range from about 1 to about 3 vol. %. Typical dilution ratios (i.e., the ratio of the vol. % of nanoparticles in the master nanocomposite to that in the final metal matrix nanocomposite) for the nanoparticles during the present methods include those in the range from 2:1 to 50:1 and further includes those in the range from 10:1 to 50:1. Although dilution ratios outside of these ranges can be used.

Example

The following example illustrates methods of casting master nanocomposites and the use of a master nanocomposite in the production of final metal matrix nanocomposites comprising an aluminum matrix and TiCN or $Al_2O_3$ nanoparticles. In addition to demonstrating the present methods for producing a final metal matrix nanocomposite using a master nanocomposite, this example examines the effect of wetting agents on the wettability and incorporation of nanoparticles during the production of the master nanocomposite.

Materials and Methods for Master Nanocomposite Production:

The effects of interfacial energy on the production of the master nanocomposites were examined by comparing the incorporation of $\gamma$-$Al_2O_3$ nanoparticles and $TiC_{0.7}N_{0.3}$ nanoparticles into Al, which was used as the nanocomposite matrix metal. The contact angle of Al on $\gamma$-$Al_2O_3$ is 150°, indicating poor wetting and high interfacial energy. Whereas the contact angle of Al on TiC is 118°, indicative of relatively good wetting and low interfacial energy. (A description of methods for obtaining these contact angles can be found in A. R. Kennedy and A. E. Karantzalis, "Incorporation of ceramic particles in molten aluminum and the relationship to contact angle data," *Mater. Sci. Eng., A,* 264 (1), (1999), 122-129).) The contact angle of Al on $TiC_{0.7}N_{0.3}$ was not found in the literature; however TiC is very similar to $TiC_{0.7}N_{0.3}$ in composition and crystal structure and likely to have a similar contact angle.

The master nanocomposites were prepared from 160-180 grams of commercially pure Al. Additions of Al-6Ti alloy and pure Mg were used to achieve the desired alloy compositions for the wetting and incorporation experiments. The alloys were melted and brought to a temperature of 715° C. in an $Al_2O_3$ crucible using an electrical resistance furnace. For experiments using Al-10Mg (alloy compositions are given in weight %, nanoparticle content is given in volume %), graphite crucibles were used. Once the molten alloy was to the appropriate temperature, the tip of an ultrasonic probe was dipped 1 cm into the melt. Sonication started once the melt temperature again reached 715° C. The ultrasonic unit used in these experiments was a Misonix Sonicator 3000 with a 12.7 mm diameter tip made of niobium alloy C103. The peak to peak displacement of the tip was 50 μm. With the melt under sonication the nanoparticles were added and processed for 20 minutes. The two types of nanoparticles used in the master nanocomposites were $TiC_{0.7}N_{0.3}$ with an average size of <150 nm and $\gamma$-$Al_2O_3$ nanoparticles with an average size of 50 nm. The nanoparticles were wrapped in aluminum foil prior to being added to the melt.

Once sonication was complete, the probe was removed from the melt and the melt temperature was increased to 760° C. The melt was then poured into a permanent steel tensile bar mold preheated to 400° C. Microstructure samples were cut, ground and polished according to standard methods. The samples were analyzed with optical microscopes as well as a LEO 1530 scanning electron microscope (SEM) with energy dispersive x-ray spectroscopy (EDS) capability. Some samples were etched with a 0.5% molar HF solution. To determine degree of nanoparticle incorporation and dispersion, unetched samples were also analyzed at 2000× magnification. Twelve randomly located images were taken and examined for nanoparticle dispersion.

Results and Discussion of Master Nanocomposite Production:

For the initial wetting experiments $TiC_{0.7}N_{0.3}$ and $Al_2O_3$ nanoparticles were added to pure Al and Al with 0.8 weight percent Mg and 0.2 weight percent Ti. SEM images from the three samples with 1.5% by volume $TiC_{0.7}N_{0.3}$ nanoparticles showed that the $TiC_{0.7}N_{0.3}$ nanoparticles were well distributed throughout the pure Al matrix. This is consistent with the expected low interfacial energy between $TiC_{0.7}N_{0.3}$ and molten Al allowing the $TiC_{0.7}N_{0.3}$ nanoparticles to be readily wetted by the molten Al. Surprisingly, though, the addition of small amounts of Mg and Ti reduced the number of $TiC_{0.7}N_{0.3}$ nanoparticles found in the nanocomposites.

A second experiment to enhance $TiC_{0.7}N_{0.3}$ nanoparticle wetting was carried out with higher Mg content. SEM images from an Al-10Mg+1.5% $TiC_{0.7}N_{0.3}$ sample showed a large number $TiC_{0.7}N_{0.3}$ nanoparticles incorporated into the nanocomposite. The vast majority of the $TiC_{0.7}N_{0.3}$ nanoparticles were found along the Al grain boundaries. This finding indicates the nanoparticles were pushed to the grain boundaries during solidification, rather than being captured by the Al grains during solidification.

SEM images from wetting experiments using 1% by volume $\gamma$-$Al_2O_3$ nanoparticles showed that the $Al_2O_3$ nanoparticles were not incorporated in the pure aluminum matrix. This is consistent with the expectations of poor nanoparticle incorporation due to the high interfacial energy between $\gamma$-$Al_2O_3$ and molten aluminum. With the addition of 0.2 percent Ti, nanoparticle wetting and incorporation was significantly enhanced as seen in the SEM images. Experiments using 0.8 Mg as a wetting agent resulted in the formation of magnesium containing oxides.

Methods of Final Metal Matrix Nanocomposite Production:

A final metal matrix nanocomposite composed of a Al-10Mg metal matrix and 0.5% dispersed $TiC_{0.7}N_{0.3}$ nanoparticles was made by remelting material from the Al-10Mg+1.5% $TiC_{0.7}N_{0.3}$ master nanocomposite in a melt of Al—Mg, followed by casting as follows. Additional Al-10Mg alloy was melted in the electrical resistance furnace and pieces of the master nanocomposite were added to make final metal matrix nanocomposites having nanoparticle contents in the range from 0.2 to 0.5 vol. %, without ultrasonic re-processing. These final metal matrix nanocomposites were then cast into the same tensile bar mold as the original 1.5% master nanocomposite. This process did not involve additional ultrasonic processing or external mixing in order to achieve the dispersion of the TiCN nanoparticles in the final nanocomposite.

Results and Discussion of Final Metal Matrix Nanocomposite Production:

The nanoparticle-induced strengthening of the Al-10Mg alloy was investigated by measuring the tensile strength of the master nanocomposite, Al-10Mg alloy, and the final metal matrix nanocomposite. Tensile strengths of as-cast alloys and nanocomposites were determined using a tensile testing machine (Sintech 10/GL, MTS, USA) with a crosshead speed of 5.08 mm/min. FIG. 1 shows the tensile test results for the Al-10Mg+1.5% $TiC_{0.7}N_{0.3}$ metal matrix nanocomposite of the master nanocomposite, as well as Al-10Mg alloy without nanoparticle reinforcement. The third data series in FIG. 1 shows the tensile test results for the final metal matrix nanocomposite of Al-10Mg+0.5% $TiC_{0.7}N_{0.3}$. As can be seen in FIG. 1, the Al-10Mg+0.5% $TiC_{0.7}N_{0.3}$ master nanocomposite-produced samples maintain most of the property enhancement of the original Al-10Mg+1.5% $TiC_{0.7}N_{0.3}$ master nanocomposite. SEM images of the final Al-10Mg+0.5% $TiC_{0.7}N_{0.3}$ nanocomposite showed the $TiC_{0.7}N_{0.3}$ nanoparticles distributed along the grain boundaries. Analysis of multiple randomly positioned high magnification images revealed that the $TiC_{0.7}N_{0.3}$ nanoparticles were well distributed throughout the samples. This master nanocomposite approach holds great commercial potential and illustrates that once wetted, nanoparticles will not segregate from the melt. Moreover, the convective flow present in the melt is sufficient to distribute nanoparticles that are added in a concentrated master nanocomposite.

Figure 2:
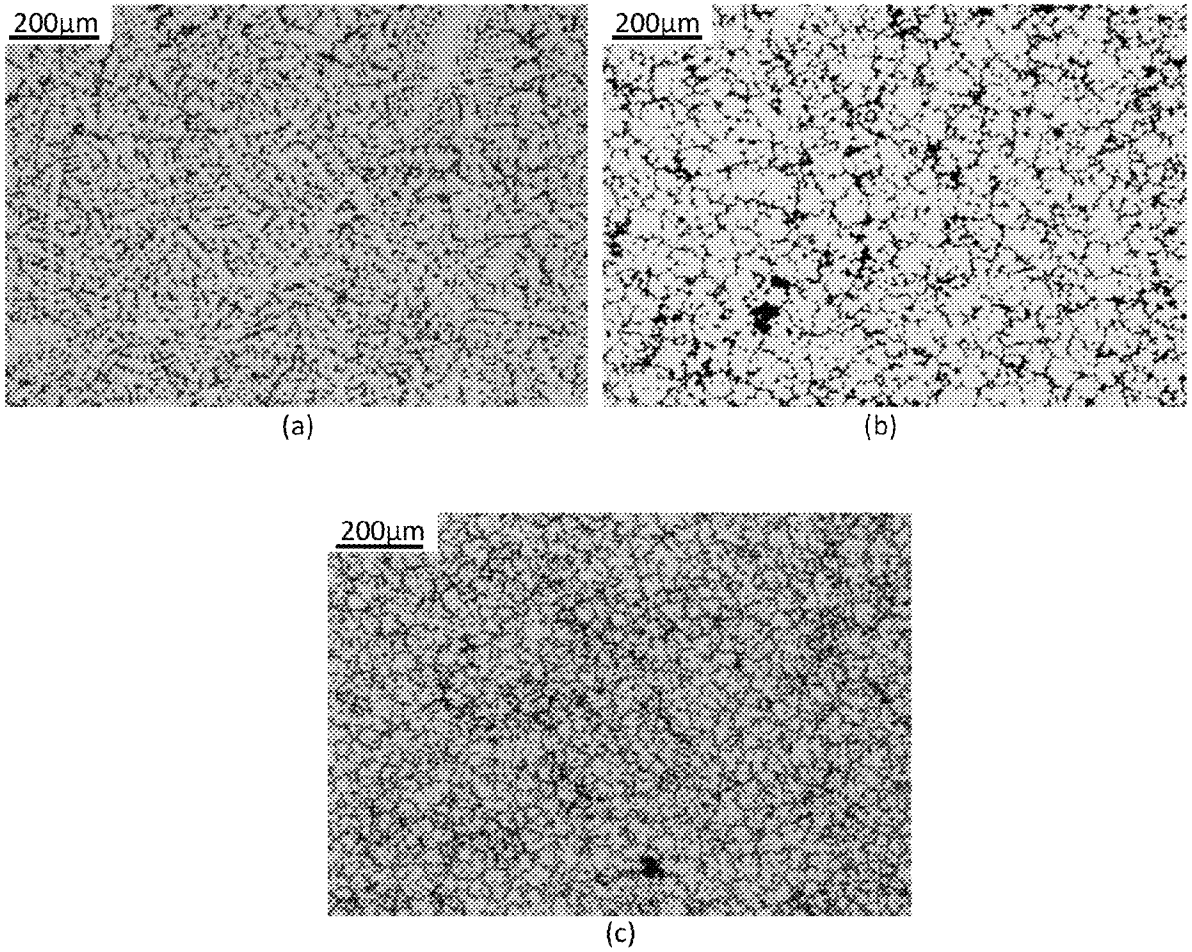
FIG. 2 shows a microstructure comparison of (a) Al-10Mg, (b) Al-10Mg+1.5% $TiC_{0.7}N_{0.3}$ nanocomposite and (c) Al-10Mg+0.5% $TiC_{0.7}N_{0.3}$ nanocomposite produced using the Al-10Mg+1.5% $TiC_{0.7}N_{0.3}$ as a master nanocomposite.

FIG. 2 shows the microstructures of the Al-10Mg alloy (FIG. 2(*a*)), Al-10Mg+1.5% $TiC_{0.7}N_{0.3}$ nanocomposite (FIG. 2(*b*)) and Al-10Mg+0.5% nanocomposite (FIG. 2(*c*)). As can be seen in the figure the two metal matrix nanocomposites have significantly smaller grains compared to the Al-10Mg sample. Specifically the Al-10Mg sample had an average grain size of 244 μm where as the Al-10Mg+1.5% $TiC_{0.7}N_{0.3}$ and Al-10Mg+0.5% $TiC_{0.7}N_{0.3}$ had average grain sizes of 96 and 66 μm respectively.

CONCLUSION

It was shown that selection of nanoparticle type and matrix alloy can have a significant impact on nanoparticle incorporation during ultrasonic metal matrix nanocomposite processing. Specifically it was shown that $TiC_{0.7}N_{0.3}$ nanoparticles were more easily incorporated into a pure Al melt than $Al_2O_3$. It was also shown that with the addition of wetting elements such as Ti, the initial difficulties in incorporating $Al_2O_3$ in pure Al can be overcome. In addition, it was shown that at large (e.g., 10%) Mg addition, $TiC_{0.7}N_{0.3}$ nanoparticle incorporation was enhanced. The resulting microstructure and mechanical properties of the Al-10Mg+1.5% $TiC_{0.7}N_{0.3}$ MMNC showed significant grain refinement and enhancement in yield strength, tensile strength and ductility. Furthermore when material from the Al-10Mg+1.5% $TiC_{0.7}N_{0.3}$ master nanocomposite was added to a Al-10Mg melt for a final metal matrix nanocomposite of Al-10Mg+0.5% $TiC_{0.7}N_{0.3}$, the final nanocomposite maintained much of the enhancement observed in the original Al-10Mg+1.5% $TiC_{0.7}N_{0.3}$ nanocomposite.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more". Still further, the use of "and" or "or" is intended to include "and/or" unless specifically indicated otherwise.

The foregoing description of illustrative embodiments of the invention has been presented for purposes of illustration and of description. It is not intended to be exhaustive or to limit the invention to the precise form disclosed, and modifications and variations are possible in light of the above teachings or may be acquired from practice of the invention. The embodiments were chosen and described in order to explain the principles of the invention and as practical applications of the invention to enable one skilled in the art to utilize the invention in various embodiments and with various modifications as suited to the particular use contemplated. It is intended that the scope of the invention be defined by the claims appended hereto and their equivalents.

What is claimed is:

1. A method of forming a metal matrix nanocomposite, the method comprising:

introducing a master metal matrix nanocomposite into a molten metal, the master metal matrix nanocomposite comprising a first matrix metal and a plurality of nanoparticles dispersed in the first matrix metal, wherein the molten metal is at a temperature above the melting temperature of the master metal matrix nanocomposite;

mixing at least a portion of the master metal matrix nanocomposite with the molten metal, wherein the compositions of the molten metal and the matrix metal of the master metal matrix nanocomposite differ, and further wherein the first matrix metal and the molten metal are independently selected such that the wettability of the molten metal on the material from which the nanoparticles are made is lower than the wettability of the first matrix metal, as measured in its liquid phase, on the material from which the nanoparticles are made; and solidifying the molten metal to provide a second metal matrix nanocomposite comprising a second matrix metal and at least a portion of the plurality of the nanoparticles dispersed in the second matrix metal.

2. The method of claim 1, wherein the molten metal is aluminum or an aluminum alloy.

3. The method of claim 1, wherein the first matrix metal comprises an alloy comprising a primary metal element and a wettability enhancing metal element.

4. The method of claim 3, wherein the primary metal element is aluminum, the wettability enhancing metal element is titanium, the nanoparticles are Al2O3 nanoparticles and the molten metal is aluminum or an aluminum alloy.

5. The method of claim 3, wherein the wettability enhancing element is not present in the molten metal prior to the introduction of the master nanocomposite.

6. The method of claim 5, wherein the primary metal element is aluminum, the wettability enhancing metal element is titanium, the nanoparticles are Al2O3 nanoparticles and the molten metal is aluminum or an aluminum alloy.

7. The method of claim 3, wherein the primary metal element is aluminum, the wettability enhancing metal element is magnesium, the nanoparticles are TiCN nanoparticles and the molten metal is aluminum or an aluminum alloy.

8. The method of claim 1, wherein the first matrix metal and the molten metal do not have the same primary metal element.

9. The method of claim 8, wherein the first matrix metal and the molten metal do not have any metal elements in common.

10. The method of claim 1, wherein the first matrix metal has a lower melting point than the molten metal.

11. The method of claim 10, wherein the molten metal comprises stainless steel.

12. The method of claim 1, wherein the first matrix metal comprises aluminum, the molten metal comprises titanium and vanadium, the nanoparticles comprise a ceramic and the second matrix metal is a TiAlV alloy.

13. The method of claim 1, wherein the first matrix metal comprises zinc or zinc alloy, the molten metal comprises aluminum or aluminum alloy, the nanoparticles comprise a ceramic and the second matrix metal is an AlZn alloy.

14. The method of claim 1, wherein the master metal matrix nanocomposite is introduced into the molten metal as a solid.

15. The method of claim 1, wherein the master metal matrix nanocomposite is introduced into the molten metal in a liquid form comprising a liquid-phase first matrix metal having the plurality of nanoparticles dispersed therein.

16. The method of claim 1, further comprising mixing the nanoparticles with a melt of the first matrix metal and casting the mixture to form the master metal matrix nanocomposite.

17. The method of claim 1, wherein the nanoparticles are ceramic nanoparticles.

* * * * *